United States Patent [19]

Labelle

[11] 4,315,648

[45] Feb. 16, 1982

[54] LOCK BOLT

[76] Inventor: Henri M. R. Labelle, 50 Westmooreland Ave., Cornwall, Ontario, Canada

[21] Appl. No.: 88,640

[22] Filed: Oct. 26, 1979

[51] Int. Cl.[3] ..... E05C 1/10

[52] U.S. Cl. ..... 292/150; 49/449; 70/100; 292/145; 292/DIG. 53; 292/DIG. 60

[58] Field of Search ..... 292/150, DIG. 60, DIG. 53, 292/145, 147, 42; 160/199, 206, 118, 117; 49/449, 394; 70/100

[56] References Cited

U.S. PATENT DOCUMENTS

| | | | |
|---|---|---|---|
| 89,191 | 4/1869 | Arnold et al. | 292/150 |
| 654,579 | 7/1900 | Ericson | 292/147 |
| 1,510,562 | 10/1924 | Segal | 292/150 |
| 3,649,060 | 3/1972 | Ruff | 292/147 X |
| 3,984,137 | 10/1976 | Tinkle | 292/150 |
| 4,058,332 | 11/1977 | DiFazio | 292/147 |

FOREIGN PATENT DOCUMENTS

| | | | |
|---|---|---|---|
| 1456539 | 9/1966 | France | 292/147 |

*Primary Examiner*—William E. Lyddane
*Attorney, Agent, or Firm*—Jack W. Paavila

[57] ABSTRACT

An improved locking bolt mechanism. The locking bolt mechanism comprises guide means, a lock bolt, and means for adjustably mounting the lock bolt to the guide means so that the lock bolt can be easily adjusted relative to the closure it is mounted on.

6 Claims, 5 Drawing Figures

LOCK BOLT

This invention is directed toward an improved locking bolt mechanism.

The invention is also directed toward a folding closure incorporating the improved locking bolt mechanism.

Locking bolt mechanisms, for use in locking closures in their closed position, are well known. The mechanism normally includes a lock bolt and means for slidably mounting the lock bolt on the closure. Manipulating means are provided on the lock bolt for moving it between locked and unlocked positions. In the locked position, one end of the lock bolt projects from the closure into a strike mounted adjacent the closure when the closure is in its closed position. In the unlocked position, the one end of the bolt is withdrawn out of the strike. Means can be provided for retaining the lock bolt in the locked or unlocked positions.

The lock bolt, in the locked position, must project the proper distance, within predetermined limits, from the closure to enter the strike. If the lock bolt does not project far enough to enter the strike, it is useless. If it projects too far, the retaining means cannot always be actuated to hold the bolt in the locked position. The lock bolts usually have a fixed length. Thus the distance the lock bolt projects from the closure, when in the locked position, is determined by where the lock bolt is mounted on the closure. When the distance between the strike, and the edge of the closure, when in its closed position, is known and is generally fixed, the mounting of the lock bolt mechanism, whether in the shop or in the field, presents no problems. If however the distance is not known, or is known to vary, the mounting can present a problem. Sometimes the lock bolt mechanism can be installed in the field. Then the mechanism can be mounted to project the proper distance when in the locked position. Field installation however can be difficult and expensive. Most often the lock bolt mechanism must be installed in the shop. The mounting is made in the same position on each closure thus simplifying installation and reducing cost. However where the distance between the strike and the closure varies in the field, alterations still must be made to the mechanism in the field to accomodate this variation in distance. Often the alterations are difficult to make particulaly when there is a large variation in distance. Large variations frequently occur in mounting large closures, such as folding closures which extend across an entire store front.

It is therefore the purpose of the present invention to provide an improved locking bolt mechanism in which the distance the lock bolt projects from the closure, when in the locked position, can be easily adjusted. It is another purpose of the present invention to provide an improved locking bolt mechanism in which the distance the lock bolt projects from the closure, when in the locked position, can be easily adjusted through a substantial distance. It is further purpose of the present invention to provide an improved locking bolt mechanism which is simple in construction, and which is easily mounted and operated.

In accordance with the present invention an improved locking bolt mechanism is provided having a guide member which can be snugly, slidably mounted within a tubular closure member. The guide member has a bracket at one end. The bracket has a threaded hole therein. A generally straight lock bolt is provided having threads on one end. The threaded end of lock bolt is screwed into the bracket. The distance the lock bolt is screwed into the bracket can be considerably varied, thus considerably varying the distance that the opposite, locking end of the lock bolt would project from the end of the closure member, when in the locked position. A handle is attached to the opposite end of the guide block. The handle projects laterally out of the closure member through a slot in the wall of the closure member and is movable between the ends of the slot to slide the lock bolt between locked and unlocked positions.

The invention is particularly directed toward a locking bolt mechanism comprising guide means and a lock bolt. Means are provided for adjustably mounting one end of the lock bolt to the guide means. Manipulating means project from the guide means, spaced from the lock bolt mounting means, for moving the lock bolt between locked and unlocked positions.

The invention is also directed toward a folding closure having a tubular member therein and a locking bolt mechanism mounted on the tubular member. The locking bolt mechanism includes guide means, adapted to be mounted for longitudinal sliding movement within the tubular member, and a lock bolt extending longitudinally within the tubular member. Means are provided for adjustably mounting one end of the lock bolt to the guide means. Manipulating means, for moving the lock bolt between locked and unlocked positions, project from the guide means through a longitudinal extending slot in the wall of the tubular member. The manipulating means are spaced from the mounting means.

The invention will now be described in detail having reference to the accompanying drawings in which.

Figure 1:
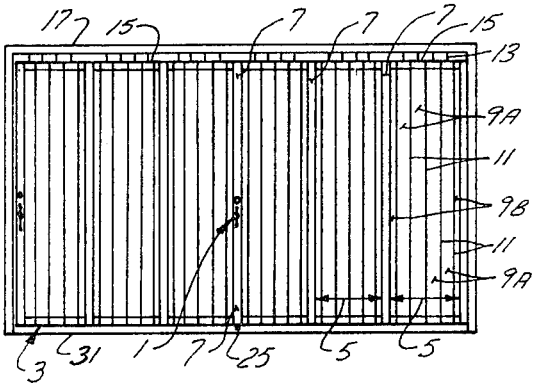
FIG. 1 is an elevation view of a folding closure in a closed position.
Figure 2:
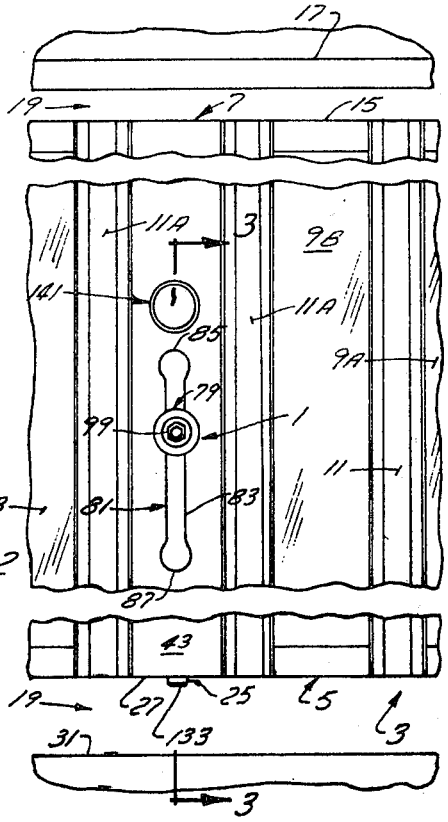
FIG. 2 is a detail elevation view of the folding closure showing the locking bolt mechanism mounted thereon.

The locking bolt mechanism 1 of the present invention, as shown in FIGS. 1 and 2, is particularly adapted for use with a folding closure 3 although it could be used with other types of closures as well. The folding closure 3 can comprise a plurality of folding sections 5 separated by vertical, tubular frame members 7. Each folding section comprises a plurality of elongated panels 9 joined together at their vertical side edges by hinges 11. A half-width panel **9*a* is provided at each end of each section 5, the remaining panels 9*b* being full-width panels. Each full-width panel 9*b* can be suspended by a rod 13 projecting up from the center of its top edge 15, and fastened to carriage means (not shown) running on a trackway 17 on the top of an opening 19. The opening 19 is closed by the closure 3 when the closure is in its open, unfolded condition. The opening 19 is opened when the closure 3 is folded up along one side of the opening. Each folding section 5 is connected to the vertical frame members 7 at its vertical side edges by hinges 11*a* connecting the free vertical side of each half-width panel 9*a* to one side of a frame member 7**.

A locking bolt mechanism 1 is provided on the closure within at least one of the centrally located frame members 7. The bolt mechanism 1 serves to lock the frame member 7 in position when the closure 3 is unfolded so as to substantially maintain the closure in its unfolded position across the plane of the opening. When the bolt mechanism 1 is actuated, a lock bolt 25, forming part of the mechanism, projects down from the bottom end 27 of the frame member 7 to enter into a strike 29 mounted in the plane of the opening 19 in the floor 31.

Figure 4:
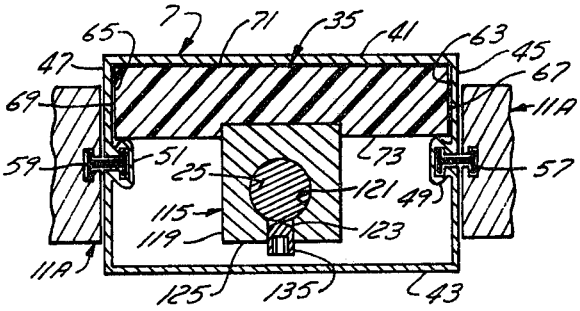
FIG. 4 is a cross-section view taken along line 4—4 of FIG. 3.
Figure 5:
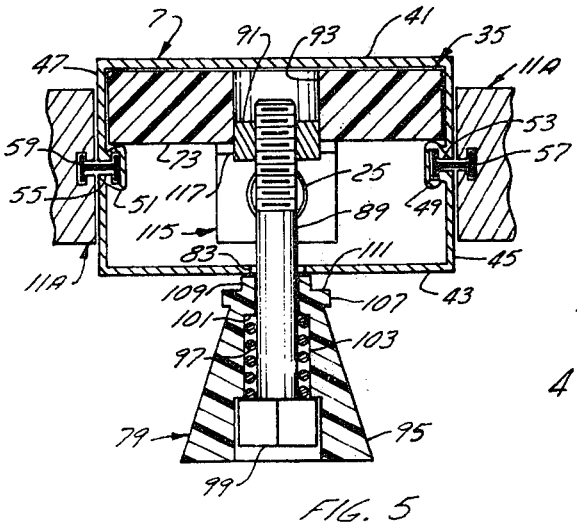
FIG. 5 is a cross-section view taken along line 5—5 of FIG. 3.
Figure 3:
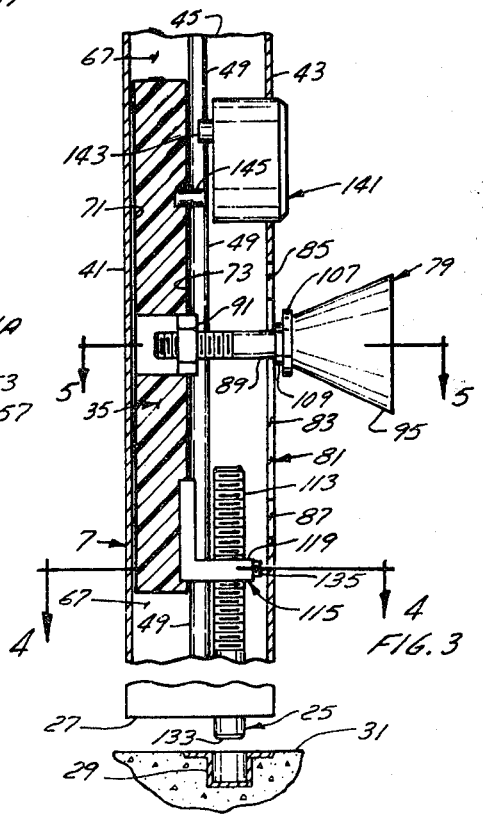
FIG. 3 is a cross-section view taken along line 3—3 of FIG. 2.

In more detail, as shown in FIGS. 3 to 5, the locking bolt mechanism 1 includes guide means. The guide means preferably comprise a guide block 35 mounted for longitudinal sliding movement within the tubular frame member or post 7. The guide block 35 is sized, in cross-section, to fit snugly within at least a portion of the cross-sectional interior space of the frame member or post 7 in a manner that permits the block to be smoothly guided for longitudinal movement within the frame member by the walls of the frame member. Preferably the post 7 is of the type having an open, rectangular cross-sectional shape with side walls 41, 43 and end walls 45, 47. Each end wall 45, 47 is provided with a rib 49, 51 respectively extending inwardly for a short distance from the center of the wall. The ribs 49, 51 extend longitudinally of the post. A T-slot 53, 55 is formed in each end wall 45, 47 respectively, extending into the ribs 49, 51 respectively to receive a hinge member 57, 59 respectively forming part of the hinges 11*a*. The guide block 35 is preferably sized, in cross-section, to fit on one side of the interior cross-sectional space of the post 7. The guide block 35 is guided for longitudinal movement within the post 7 with its edges 63, 65 adjacent the portions 67, 69 of the post end walls 45, 47 lying between ribs 49, 51 and the back wall 41 of the post. One side 71 of the block lies adjacent the back wall 41 of the post 7. The opposite side 73 of the block lies adjacent the ribs 49, 51. The guide block 35 is thus snugly guided for longitudinal movement within the post 7 along one side of the post. The guide block 35 can be made from suitable material, such as nylon, to enhance its sliding movement within the post 7.

Manipulating means move the guide block 35 within the post 7. The manipulating means can comprise a handle 79 attached to the approximate center of the block. The handle 79 projects from side 73 of the guide block 35 and out through a central slot 81 in the facing front wall 43 of the post. The slot 81 extends longitudinally of the post 7 for a short distance and has a narrow elongated central portion 83 with top and bottom enlarged circular portions, 85, 87 at each end of the central portion 83. The slot 81 is generally located between waist and chest level in post 7. The length of the slot defines the throw of the lock bolt. The handle 79 includes a threaded bolt 89, the bolt end being threaded into a nut 91 which is fixed in a throughhole 93 in the guide block 35. A knob 95 is slidably fastened to the other end of the bolt 89. The knob 95 is biased toward the post 7 by a coil spring 97 mounted on bolt 89. One end of the spring 97 bears against the head 99 of the threaded bolt. The other end of the spring 97 bears against a shoulder 101 formed toward the rear of knob 95. The knob 95 is undercut forwardly of the shoulder 101 to form a recess 103 for receiving the spring 97 when the spring is mounted on the bolt. The knob includes stop means rearwardly of the shoulder 101 which bears on the outside surface of wall 43 of the post. The stop means can comprise a disk-shaped member 107 attached to the rear of the knob. The member 107 can be formed integrally with the knob. Retaining means are included on the handle 79. The retaining means can include a second disk-shaped member 109 attached to the rear surface 111 of the stop member 107. The retaining member 109 is smaller than the stop member 107 and is concentric therewith. The retaining member 109 has a diameter slightly smaller than the diameter of the enlarged circular portions 85, 87 of the slot 81, but larger than the width of the central portion 83 of the slot. The retaining member 109 can be made integral with the stop member 107 and the knob 95.

A bracket 115 is attached to the lower end of the guide block 35 spaced below the handle 79. The bracket 115 is L-shaped and has a first arm 117 fixed to the block and a second arm 119 extending perpendicularly from the first arm, and the block toward the front wall 43 of the post. A first threaded hole 121 is provided in the second arm 119 with its axis extending perpendicular to the second arm 119. A second, smaller threaded hole 123 extends inwardly from the front edge 125 of the second arm 119 to the first hole 121. The axis of the second hole 123 is perpendicular to the axis of the first hole 121. The second hole 123 is aligned with the slot 81.

The lock bolt 25 comprises a generally straight rod having sufficient length to extend generally from the top of slot 81 to the bottom of post 7. The upper end 131 of the lock bolt 25 is threaded for a distance of at least several inches, the distance between the second arm 119 of bracket 115 and handle 79. The threaded upper end 131 of the lock bolt 25 is threaded into the first hole 121 in the bracket 115. The extent to which the lower end 133 of the bolt 25 projects from the bottom end 27 of the post 7, with the bolt 25 in the locking position, is determined by how far the bolt is threaded into bracket 115. The less the bolt is threaded into the bracket, the greater the distance the lower end 133 of the bolt projects from bottom end of the post. Once the desired position of the bolt is obtained, during installation of the closure, a set screw 135, inserted into the second hole 123 in the bracket 115 is tightened against the lock bolt 25 to lock it in position. Access to the set screw 135 is through slot 81, when the handle 79 is in its upper, unlocked position.

In operation, when the closure 3 is unfolded across the opening 19 to close the opening, the handle 79 can be operated to move the lock bolt 25 to a locked position to maintain the unfolded closure in the plane of the opening. In the locked position, the bottom end 133 of the lock bolt 25 fits into the strike 29 with the handle 79 retained in the bottom position 87 of the slot 81. The retaining member 109 on the handle 79 is forced by the spring 97 into the enlarged bottom portion 87 of the slot 81. A cylinder lock 141 may be provided in the post, located just above the slot 81, to lock the bolt in place. The lock 141 is mounted in front wall 43 of post 7. The locking pin 143 on the cylinder lock 141 cooperates with a locking pin 145 projecting from the upper end of the surface 73 of the guide block 35 to retain the bolt 25 in its lower locked position. With the lock bolt securely in the strike 29, the post 7, and thus the closure 3 of which it is a part, is locked in the plane of the opening.

To unlock the post 7, and thus closure 3, the cylinder lock 141 is unlocked and the handle knob 95 can be pulled out against the action of spring 97 to remove the handle retaining member 109 from the lower end 87 of the slot 81. The handle 79 can now be moved up the narrow central slot portion 83 pulling the guide block 35, and the attached lock bolt 25, with it. This removes the lower end of the lock bolt from the strike. The handle 79 is moved to the top of the slot 83 and here the spring 97 forces the handle retaining member 109 into the top enlarged portion 85 of the slot so as to retain the bolt 25 in its raised, unlocked position.

It will be seen that an extremely simple locking bolt mechanism has been provided which can be easily adjusted in the field to have the lock bolt project the desired distance from the post when in the locking position. In addition, the mechanism provides for a relatively large degree of lock bolt adjustment, limited only by the distance that the lock bolt can be threaded into the bracket. The arrangement of the mechanism, permits the lock bolt to be generally centrally mounted within the frame member while securely guided for movement therein.

I claim:

1. A closure having a tubular frame member therein; a locking bolt mechanism mounted on the tubular frame member; the locking bolt mechanism including: guide means adapted to be mounted for longitudinal sliding movement within the tubular frame member, a lock bolt extending longitudinally within the tubular member, one end of the lock bolt mounted to the guide means, the other end projecting from the closure, the mounted lock bolt adjustable longitudinally relative to the guide means, manipulating means for moving the lock bolt between locked and unlocked positions, the manipulating means projecting from the guide means through a longitudinally extending slot in a wall of the tubular frame member, means for locking the one end of the lock bolt to the guide means after the lock bolt has been longitudinally adjusted to a desired position relative to the guide means, the locking means positioned to be accessible through the slot in at least one position of the lock bolt.

2. A closure as claimed in claim 1 wherein the locking means comprise a locking screw extending transverse to lock bolt, the locking screw aligned with the slot; and having its head facing the slot.

3. A closure as claimed in claim 1 wherein the one end of the lock bolt is threaded, the guide means having a threaded bore into which the one end of the lock bolt is threaded.

4. A closure as claimed in claim 3 wherein the guide means comprises a guide block; the tubular frame member having a rectangular cross-sectional shape with opposing side walls and end walls connecting the side walls, a longitudinal rib centrally located on the inner surface of each end wall of the tubular frame member, the guide block sized to fit snugly between the ribs and one side wall, the slot located in the other side wall.

5. A closure as claimed in claim 4 including an arm projecting from the guide block toward the other side wall, the threaded bore located in the arm.

6. A closure as claimed in claim 5 wherein the locking means comprise a locking screw threaded into a second threaded bore in the arm which second bore extends from the free end of the arm toward the guide block to intercept the first threaded bore, the head of the locking screw adjacent the other side wall and aligned with the slot.

* * * * *